US007731082B2

(12) United States Patent
Jackson et al.

(10) Patent No.: US 7,731,082 B2
(45) Date of Patent: Jun. 8, 2010

(54) CONTINUOUSLY WOUND REINFORCED CONTAINER AND METHOD OF MAKING THE SAME

(75) Inventors: Keith A. Jackson, Gurnee, IL (US); Benjamin Frank, Buffalo Grove, IL (US)

(73) Assignee: Packaging Corporation of America, Lake Forest, IL (US)

( * ) Notice: Subject to any disclaimer, the term of this patent is extended or adjusted under 35 U.S.C. 154(b) by 948 days.

(21) Appl. No.: 11/429,713

(22) Filed: May 8, 2006

(65) Prior Publication Data

US 2007/0257094 A1 Nov. 8, 2007

(51) Int. Cl.

| | |
|---|---|
| ***B65D 5/42*** | (2006.01) |
| ***B65D 3/22*** | (2006.01) |
| ***B65D 65/00*** | (2006.01) |
| ***B65D 71/08*** | (2006.01) |

(52) U.S. Cl. ..... 229/199; 229/117.3; 229/122.33; 229/122.34; 206/497

(58) Field of Classification Search ..... 299/199, 299/122.32, 122.34, 117.3; 206/280, 497, 206/451, 597; 220/639, 643, 646
See application file for complete search history.

(56) References Cited

U.S. PATENT DOCUMENTS

| | | | | |
|---|---|---|---|---|
| 2,440,193 | A | 4/1948 | Davis et al. | |
| 2,745,591 | A | 5/1956 | Holt, Jr. | |
| 3,832,827 | A | 9/1974 | Lemelson | |
| 4,160,519 | A | 7/1979 | Gorham | |
| 4,366,021 | A | 12/1982 | van der Wal | |
| 4,409,776 | A | 10/1983 | Usui | |
| 4,641,488 | A | 2/1987 | Garr | |
| 4,702,408 | A | 10/1987 | Powlenko | |
| 4,718,597 | A | 1/1988 | Bishop | |
| 4,746,011 | A | 5/1988 | McNair, Jr. et al. | |
| 4,784,271 | A | 11/1988 | Wosaba, II et al. | |
| 4,905,451 | A | 3/1990 | Jaconelli et al. | |
| 5,025,608 | A | 6/1991 | Marchetti | |
| 5,027,581 | A | 7/1991 | Kovacs | |
| 5,314,557 | A | 5/1994 | Schwartz et al. | |
| 5,351,849 | A | 10/1994 | Jagenburg et al. | |
| 5,423,163 | A | 6/1995 | Wendt | |
| 5,447,009 | A | 9/1995 | Oleksy et al. | |
| 5,768,862 | A | 6/1998 | Mauro | |
| 5,772,108 | A | 6/1998 | Ruggiere, Sr. et al. | |
| 6,095,409 | A | 8/2000 | Tsai | |
| 6,588,651 | B2 * | 7/2003 | Quaintance | 229/109 |
| 6,745,544 | B2 * | 6/2004 | Matsumoto et al. | 53/399 |
| 6,893,528 | B2 | 5/2005 | Middelstadt et al. | |
| 6,945,018 | B2 | 9/2005 | Suolahti | |
| 2005/0205652 | A1 * | 9/2005 | Clohessy | 229/122.34 |

* cited by examiner

*Primary Examiner*—Gary E Elkins
*Assistant Examiner*—Latrice Byrd
(74) *Attorney, Agent, or Firm*—Nixon Peabody LLP

(57) ABSTRACT

A reinforced container assembly and method for making the same are provided. The reinforced container assembly comprises a fiberboard container and a first reinforcement strap. The fiberboard container has a lower portion and an upper portion. The first reinforcement strap wraps continuously around a periphery of the container a plurality of times in a spiraling manner from a starting point of the reinforcement strap to a terminating point of the reinforcement strap. The reinforcement strap physically connects to the container at a first location. The reinforcement strap is further physically connected to the container at second location. The reinforcement strap provides structural support to the fiberboard container to increase the strength of the container assembly.

28 Claims, 4 Drawing Sheets

CONTINUOUSLY WOUND REINFORCED CONTAINER AND METHOD OF MAKING THE SAME

FIELD OF THE INVENTION

The present invention relates generally to containers for retaining and protecting goods during shipment and methods for making such containers. In particular, the present invention relates to a continuously wound reinforced shipping container.

BACKGROUND OF THE INVENTION

Corrugated fiberboard containers have been used for many years as shipping and storage containers for a large variety of products. Corrugated fiberboard generally refers to a multi-layer sheet material comprised of sheets of liner bonded to central corrugated layers of medium. Single-wall corrugated involves two sheets of liner bonded on alternate sides of one corrugated medium, while double-wall corrugated involves three liners bonded alternatively to two corrugated mediums. Corrugated fiberboard containers can vary greatly in size depending on the intended usage of the container.

The distribution of products in large containers is common in a wide variety of industries, from automotive to food. Corrugated semi-bulk containers ("CBCs") serve as an example common in the meat industry for storing and shipping beef, pork, and other animal products between processing facilities, and from those processing facilities to customers. CBCs often require local horizontal zones of additional reinforcement for containment, to prevent container failure and ensure products are saleable when they arrive at the end of the distribution process and any auxiliary processes. Reinforcement methods are often used on CBCs and other corrugated containers in order to increase the performance more cost-effectively (by localizing the region of peak performance) than by switching to some other container material or increasing the overall strength of the corrugated component of the CBC.

Internal reinforcement of corrugated board can include polymeric straps located between one of the sheets of liner and one of the mediums to further enhance the bulge or tear resistance of the structure, increasing the performance of the overall container. However, even when polymeric straps are included within the corrugated board structure, a weak spot will occur at the manufacturing joint, which is the area of overlap of the fiberboard sheet when a container is formed. Because the corrugated board is discontinuous at this joint, the internal reinforcement is also discontinuous, creating a failure nucleation zone at the joint. This weakness is typically overcome by using external reinforcement in conjunction with or in lieu of internal reinforcement.

External reinforcement is most often accomplished by the use of multiple horizontal bands of strapping material. These external reinforcing straps may be placed on the container when it is in a flat semi-assembled orientation before being formed into a typically shaped container ("knocked down") or may be applied after the container has been formed into its final typical shape ("set-up"). Previous reinforcing straps have been made from metallic materials or polymeric materials. The reinforcing straps are formed onto a set-up CBC or around a knocked down CBC in a continuous loop, with the two ends of the strapping material typically attached together using methods common in the industry. Metallic straps may be crimped together, while polymeric straps may be heat welded together.

Frequently, reinforcing straps are applied so that the spacing between two adjacent straps is generally equal around the periphery of the container, whether they are applied to containers in a knocked down or set up configuration, i.e. the straps are typically parallel. The reinforcing straps are spaced some distance apart along the height of the container. When straps are applied to a container in a set up configuration, the reinforcing straps are typically applied one-at-a-time by one or more individuals. The process of adding reinforcing straps to the container in a set up configuration often results in large variations in strap placement and strap tightness when comparing several containers, with an associated variation in strap impact on overall container performance.

Reinforcing straps applied to containers while the containers are in a knocked down orientation typically are applied in a semi-automated process. In the semi-automated mode one automatic strapper is used to apply straps. One or more individuals moves the knocked down CBC through the strapper manually, with the external straps applied at predetermined locations. While this process only requires one strapping machine, it is quite slow and requires significant manual labor. Strap placement accuracy depends on the patience and attention of the operators. This process can be automated (intermittent motion) on a conveyor, by having the CBC stop at fixed locations relative to the individual strapper, so that the external straps are applied at the specified locations. It can be further automated by using one strapping machine for every band/strap placed on the box (frequently 3 or more). Not only does this require extensive capital expense but also a dedicated manufacturing line. Initial strap placement is typically controlled to within roughly one-to-two strap widths of the target location, depending on the mechanism by which the knocked down CBC is started and stopped on the manufacturing line.

Reinforcing straps currently used are individually joined continuous loops that are not physically attached to the container so as to prevent movement or sliding of the bands. They rely on the tension of the strapping material as well as friction to stay in place. If the tension is high, the strap will remain precisely where placed at the risk of also deforming or damaging the CBC, potentially decreasing container performance. Typically, tension levels are set to avoid significantly damaging the container while allowing the strap to remain in an intended location by friction. When strap tension level is low, bands often slip from their intended locations when the containers are put into use, increasing the likelihood of lower container performance.

Additionally, reinforcement straps currently used typically have a much higher elongation at failure compared to the corrugated fiberboard material used to make the containers. Corrugated fiberboard typically has an elongation at failure of about between one and a half percent and two percent (1.5%-2%). Many polymeric reinforcement straps used currently have an elongation at failure of about fifteen percent (15%). This near order of magnitude difference of elongation at failure requires that the strapping material used be selected so that it has the necessary strength to reinforce the container at the elongation of failure of the corrugated fiberboard, to ensure that the straps help prevent the failure of the fiberboard, not simply help to contain the contents of the container after the fiberboard fails. This is important as some customers will not accept the contents of a container if the container has been breached. Using a material in a reinforcing strap that has the required strength at the elongation at failure of the corrugated material typically requires that a much stronger material be used, as most materials have their greatest strength just prior to failure. Thus, the majority of the strength of the reinforcing strap goes unused.

Thus, it would be desirable to use a reinforcement material that is physically attached to the container, and which further is made of one continuous piece to allow for quicker application. It would be further desirable to use a reinforcing material with a more similar elongation at failure than that typically used currently for container reinforcement.

SUMMARY OF THE INVENTION

According to one embodiment of the present invention, a reinforced container assembly comprises a fiberboard container and a first reinforcement strap. The fiberboard container has a lower portion and an upper portion. The first reinforcement strap wraps continuously around a periphery of the container a plurality of times in a generally spiraling manner from a starting point of the reinforcement strap to a terminating point of the reinforcement strap. The first reinforcement strap is physically connected to the container at a first location. The first reinforcement strap is further physically connected to the container at second location. The first reinforcement strap provides structural support to the fiberboard container to increase the strength of the container assembly.

According to one process of the present invention a method of reinforcing a fiberboard container is provided. The process provides a fiberboard container that has a lower portion and an upper portion. Additionally, a first reinforcement strap that has a first end and a second end is provided. The first reinforcement strap physically attaches to the container at a first position. The reinforcement strap wraps around a periphery of the container a plurality of times in a generally spiraling pattern. The first reinforcement strap physically attaches to the container at a second position such that a vertical spacing exists between the first position and the second position when the container is in a set-up configuration.

According to another process of the present invention, a method of reinforcing a fiberboard container is provided. The method provides a corrugated fiberboard container that has internal polymeric reinforcing straps. The container has a lower portion and an upper portion. A first fiberglass reinforced adhesive tape reinforcement strap is additionally provided. A first location of the first reinforcement strap physically attaches to the container at a first position. The reinforcement strap wraps around a periphery of the container a plurality of times in a generally spiraling pattern from the lower portion of the container to the upper portion of the container. The first reinforcement strap physically attaches to the container during the act of wrapping. A second location of the first reinforcement strap physically attaches to the container at a second position.

According to another embodiment of the present invention, a reinforced container assembly comprises a fiberboard container and a first reinforcement strap. The fiberboard container has a lower portion, an upper portion, and a sidewall outer surface area. The first reinforcement strap wraps continuously around a periphery of the container a plurality of times. At least a first wrap of the first reinforcement strap occurs in a first generally identical vertical location of the container before the wraps form a generally spiraling pattern. The first reinforcement strap physically connects to the container at a first location at a first position of the first reinforcement strap. The first reinforcement strap further physically connects to the container at a second location at a second position of the first reinforcement strap. The reinforcement strap provides structural support to the fiberboard container to increase the strength of the container assembly. Wherein, the distance between each of the plurality of wraps in the generally spiraling pattern of the first reinforcement strap around the periphery of the container is greater than a width of the first reinforcement strap.

BRIEF DESCRIPTION OF THE DRAWINGS

Other advantages of the invention will become apparent upon reading the following detailed description and upon reference to the drawings in which.

Figure 1:
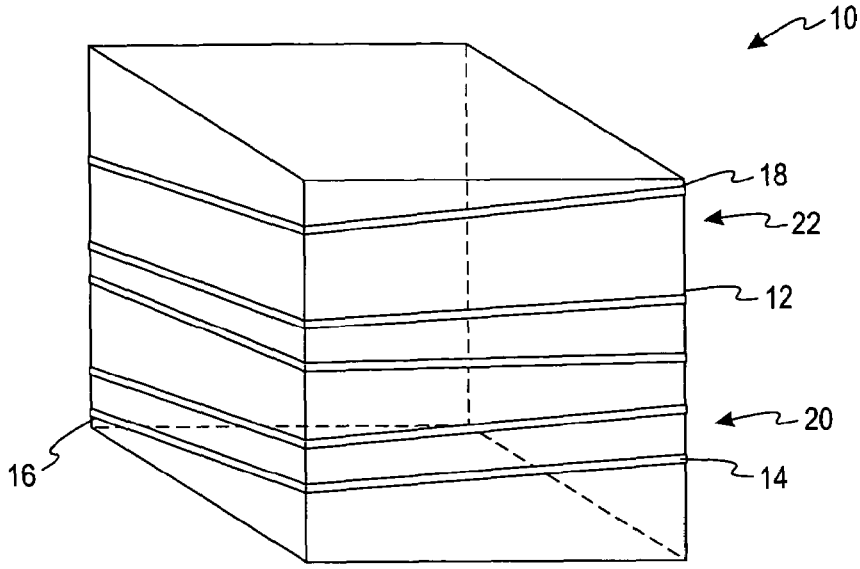
FIG. 1 is an isometric view of a container having a continuously wound reinforcement strap applied according to one embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Turning now to FIG. 1, a reinforced container assembly 10 according to one embodiment of the present invention is shown. The reinforced container assembly 10 is adapted to hold contents being transported from a first location to a second location. The reinforced container assembly 10 comprises a fiberboard container 12 and a continuous reinforcement strap 14. The fiberboard container 12 may be a single-wall or a double-wall corrugated fiberboard container. The fiberboard container 12 has a lower portion 20 and an upper portion 22. The fiberboard container 12 further has a side wall outer surface area comprising a sum of the length dimension of each side wall of the container 12 multiplied by the height dimension of each respective side wall of the container 12. The reinforcement strap 14 is a single generally seamless reinforcement strap continuously wound around a periphery of the fiberboard container 12.

The reinforcement strap 14 is manufactured from a material with less than five times the elongation at failure as the fiberboard used to form the container 12. Thus, for example, if the fiberboard has an elongation at failure of two percent (2%) the reinforcement strap would have an elongation at failure of less than ten percent (10%) at the time of application. Non-limiting examples of materials that may be utilized for the reinforcement strap include reinforced packaging tape, adhesive tape, polymeric film, and stretch polymeric string. The polymeric film and the stretch polymeric string may be pre-stretched, such that the polymeric material has already been elongated a certain amount prior to being wrapped around the container 12.

According to one embodiment, the reinforcement strap 14 is physically attached to the container 12 in at least two locations. The reinforcement strap 14 may physically attach to the container at the beginning of the strap 16 and the end of the strap 18, or the reinforcement strap 14 may physically attach to the container 12 in at least two locations between the beginning of the strap 16 and the end of the strap 18. The reinforcement strap 14 may be continuously attached along its length to the container 12. Attaching the reinforcement strap 14 to the container 12 continuously assures that the location of the reinforcing strap 14 will not change as the reinforced shipping container assembly 10 is transported.

Additionally, attaching the reinforcement strap 14 continuously along its length further enhances the ability of the reinforcement strap 14 to retain the structural integrity of the container 12, as both the strength of the container 12 and the reinforcement strap 14 must be overcome to rupture the container assembly 10. Therefore, a continuously applied reinforcement strap 14 provides a greater amount of reinforcement to the container 12 than currently used systems.

Further, attaching the reinforcement strap 14 continuously around the periphery of the container assembly 10 significantly reinforces the manufacturing joint, improving the strength of the manufacturing joint of the container that arises a discontinuity in any internal reinforcement of the manufacturing joint.

According to one embodiment of the present invention, the reinforcement strap 14 is a reinforced adhesive tape. Using a reinforced adhesive tape for the reinforcement strap 14 allows the reinforcement strap 14 to be continuously attached to the container 12. One example of a reinforced tape is a fiberglass reinforced pressure sensitive tape. The fiberglass reinforced pressure sensitive tape has an elongation at failure of approximately three percent (3%).

Referring still to FIG. 1, the reinforcement strap 14 generally spirals around the container 12. That is, as the reinforcement strap 14 is wound around the container 12, the reinforcement strap 14 also moves in a direction generally perpendicular to the direction the strap 14 is being wrapped in. As shown in FIG. 1, the vertical spacing between each wrap of the reinforcement strap 14 generally increases moving from the lower portion 20 of the container 12 to the upper portion 22 of the container 12. Therefore, additional reinforcement is provided to the lower portion 20 of the container 12. It is further contemplated that the reinforcement strap 14 may be overlapped at the lower portion of the container 12, before the strap 14 spirals up the container 12, providing additional reinforcement to the lower portion of the container 12. It is further contemplated that the strap 14 may be overlapped at any pre-selected portion of the container 12 to provide additional reinforcement at that pre-selected portion of the container 12. It is contemplated that the strap 14 will cover less than thirty five percent (35%) of the side wall outer surface area of the container 12.

Similarly, it is contemplated that according to an alternate embodiment, the vertical spacing between each wrap of a reinforcement strap may decrease moving from a lower portion of a container to an upper portion of the container, thereby providing additional reinforcement to the upper portion of the container.

Figure 2:
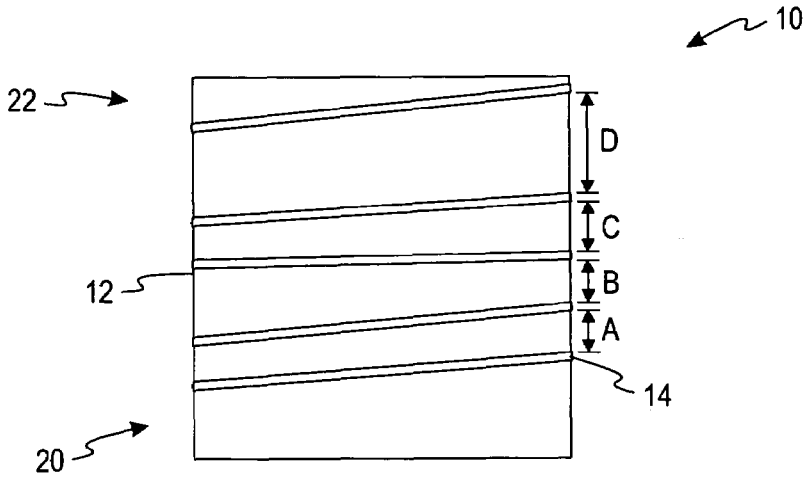
FIG. 2 is a front view of the shipping container of FIG. 1.

As shown in FIG. 2, a distance A is shown between a first and second wrap of the reinforcement strap 14, a distance B is shown between the second and a third wrap of the reinforcement strap 14, a distance C is shown between the third and a fourth wrap of the reinforcement strap 14. The distance C is greater than the distance B. The distance B is greater than the distance A. Thus, the distance between wraps of the reinforcement strap 14 at the upper portion 22 of the container 12 is larger than the distance between wraps of the reinforcement strap 14 at the lower portion 20 the container 12. It is contemplated that the distance between each wrap of the reinforcement strap 14, such as the distances A, B, C, and D, is greater than a width of the strap 14.

The number of wraps of the reinforcement strap 14 may vary based on the application of the container 12 and the desired strength of the reinforced shipping container assembly 10. Typically a reinforcement strap is wound around a container between three and ten times. Five wraps of the reinforcement strap 14 are depicted in FIG. 1. It is additionally contemplated that a second reinforcement strap may be added to a container to provide an even greater amount of reinforcement and/or increase the speed of application of the reinforcement. The second reinforcement strap may follow the same path as a first reinforcement strap or it may follow a different path than the first reinforcement strap, such as a reverse path of the first strap.

Figure 4:
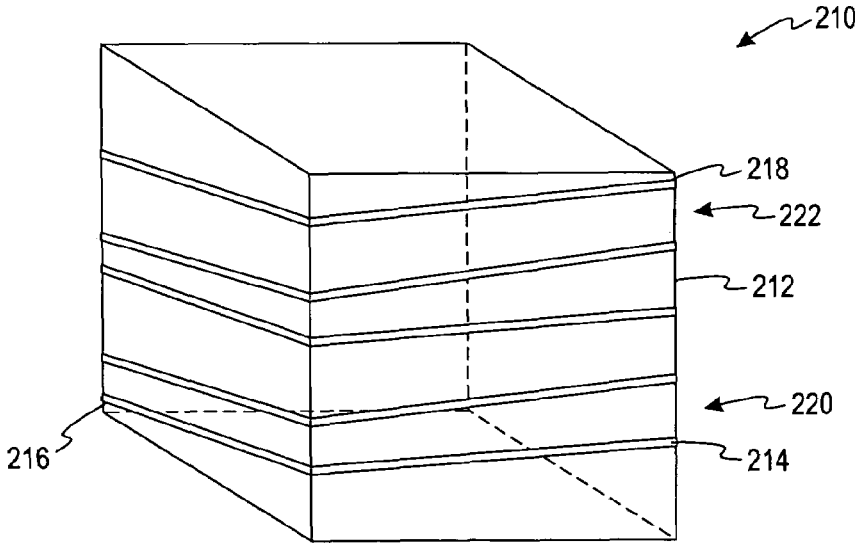
FIG. 4 is an isometric view of a container having a continuously wound reinforcement strap applied according to another embodiment of the present invention.

As shown in FIG. 4, a reinforced container assembly 210 comprises a fiberboard container 212 and a continuous reinforcement strap 214. The fiberboard container 212 may be a single-wall or a double-wall corrugated fiberboard container. The fiberboard container 212 has a lower portion 220 and an upper portion 222. The reinforcement strap 214 is a single generally seamless reinforcement strap continuously wound around a periphery of the fiberboard container 212. The reinforcement strap spacing varies from wrap to wrap. For example, a small spacing may exist between wraps at a lower portion 220 of the container assembly 210 and at an upper portion 222 of the container assembly, and a larger spacing may exist between wraps of the reinforcement strap 214 in the area of the container assembly between the lower portion 220 and the upper portion 222.

Figure 5:
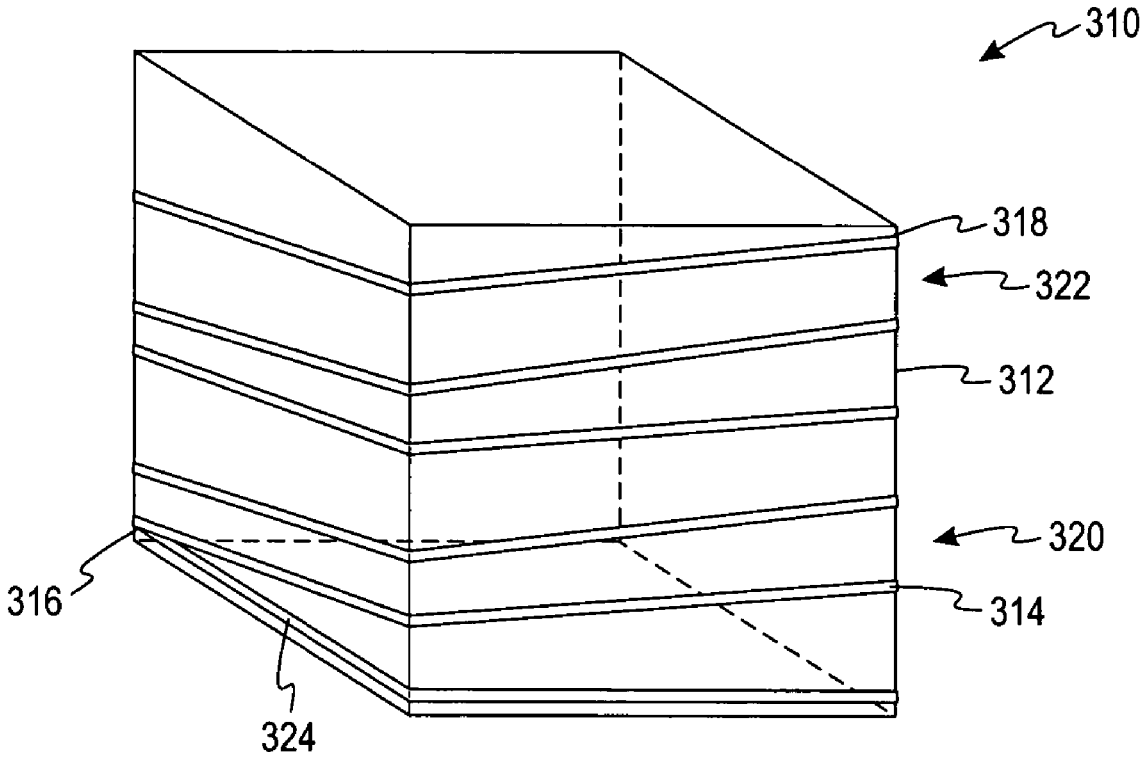
FIG. 5 is an isometric view of a container having a continuously wound reinforcement strap applied according to a further embodiment of the present invention.

Turning next to FIG. 5, a reinforced container assembly 310 according to a further embodiment of the present invention comprises a fiberboard container 312 and a continuous reinforcement strap 314. The fiberboard container 312 may be a single-wall or a double-wall corrugated fiberboard container. The fiberboard container 312 has a lower portion 320 and an upper portion 322. The reinforcement strap 314 is a single generally seamless reinforcement strap continuously wound around a periphery of the fiberboard container 312. A first wrap 324 of the reinforcement strap 314 is located at generally a single vertical location around the periphery of the container 312. After the first wrap 324, the reinforcement strap forms a generally spiraling pattern around the periphery of the container 312.

It is further contemplated that the spacing of a reinforcement strap may be completely variable based on a particular application of the container assembly. For example, it is contemplated that the spacing between wraps may be less at a middle portion of the container assembly relative to a top and bottom portion of the container assembly to provide additional reinforcement at a predetermined portion of the container assembly. Further, according to another example, the spacing between wraps of the reinforcing strap may be small at a bottom portion of a container assembly, large at a middle portion of a container assembly, and small at a top portion of a container assembly based on a particular application of the container assembly.

Figure 3:
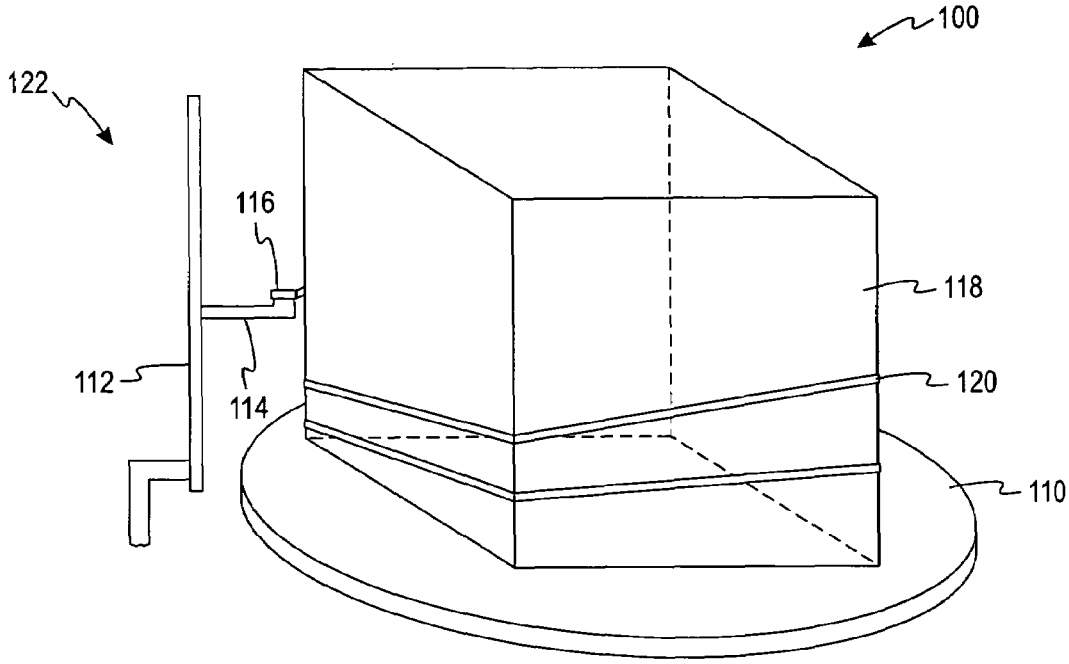
FIG. 3 is a isometric view of a shipping container having a reinforcing strap applied according to one process of the present invention.

Turning now to FIG. 3, one process of applying a reinforcing strap 120 to a container 118 that has been erected to form a reinforced container assembly 100 is shown. The container 118 rests on a turntable 110 that is adapted to rotate the container three-hundred and sixty degrees (360°). A reinforcing strap applying assembly 122 is adapted to apply the reinforcing strap 120 to the container 118 as the container 118 rotates on the turntable 110. The strap applying assembly 122 comprises a vertical support 112 a horizontal arm 114 and a tape dispensing mechanism 116. The horizontal arm 114 is adapted to move vertically about the vertical support 112. The tape dispensing mechanism 116 is adapted to attach to the horizontal arm 114 and apply the reinforcing strap 120 to the container 118 as the container 118 rotates.

The relative rates of movement of the horizontal arm 114 about the vertical support 112 and the turntable 110 rotational speed determine the distance between wraps of the reinforcing strap 120. For example, if a complete overlap is desired for a particular reinforcing wrap, the horizontal arm 114 remains stationary on the vertical support 112 as the container 118 completes one revolution on the turntable 110. To increase the spacing between wraps of the reinforcing strap 120 the horizontal arm 114 move up the vertical support at a faster rate as the container 118 rotates on the turntable 110. To decrease the spacing between wraps of the reinforcing strap 120 the horizontal arm 114 move up the vertical support 112 at a slower rate as the container 118 rotates on the turntable 110. Alternately, the horizontal arm 114 may move up the vertical support 112 at a constant rate while the turntable 110 rotates to create uniform spacing between the wraps of the reinforcing strap 120. Thus, the distance between wraps of the reinforcing strap 120 may be optimized for each particular application of a container.

Additionally, as the reinforcing strap is physically attached to the container, the number of wraps may include a partial wrap, so as to provide a more exact amount of reinforcement to a container assembly for a particular application.

Figure 6:
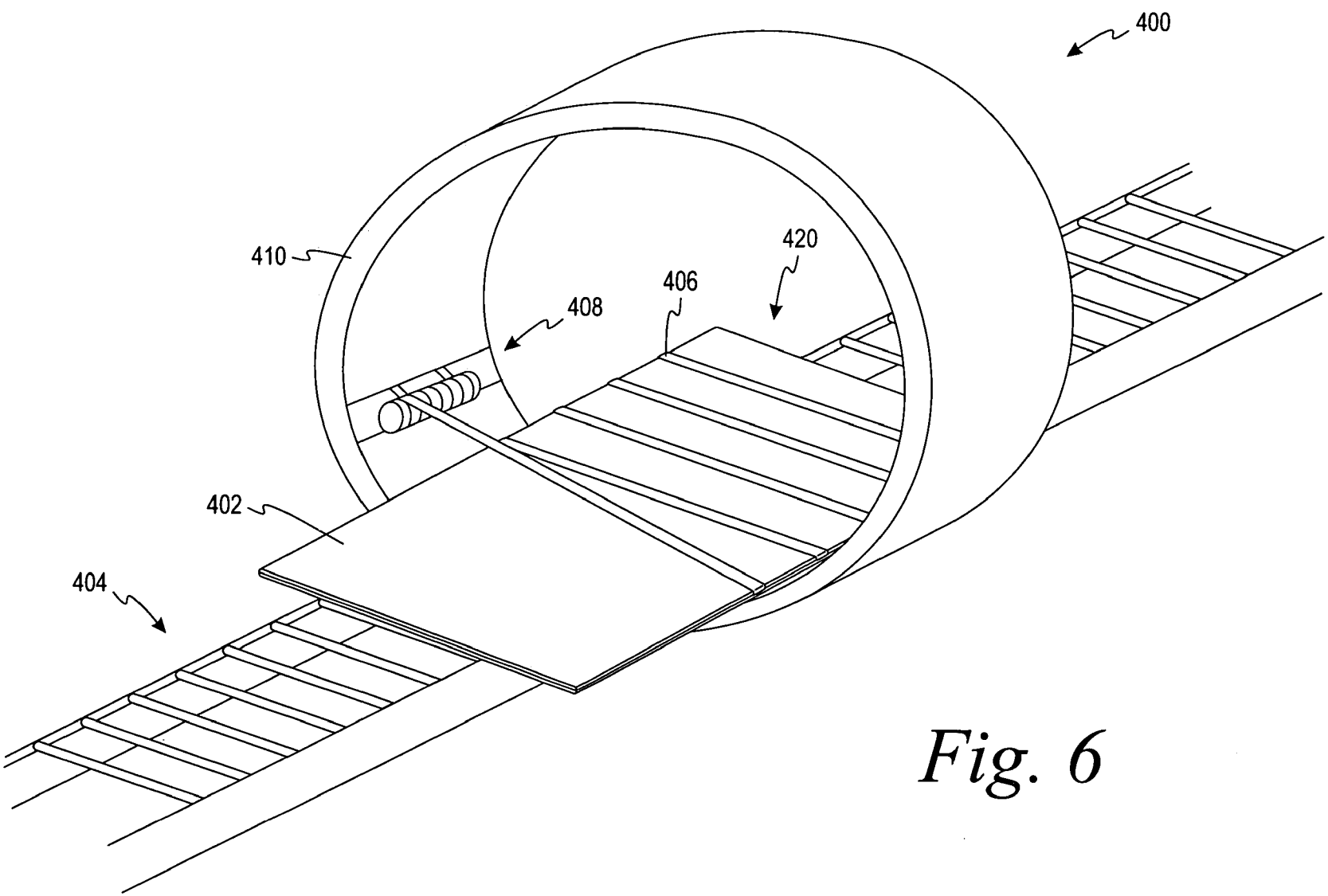
FIG. 6 is an isometric view of a container having a continuously wound reinforcement strap applied according to a further embodiment of the present invention.

It is further contemplated that a continuously wound reinforcing strap may be applied to a container in a knocked down position, as shown in FIG. 6. In such a method a strap applying assembly 400 applies a reinforcing strap 406 to a container in a knocked down position 402. The container 402 is supported by a conveyor belt system 404 adapted to transport the container 402 as the reinforcing strap 406 is applied. The strap applying assembly 400 further comprises a tape dispensing mechanism 408 that is mounted to a track 410 that encircles the container 402 and the conveyor 404. The tape dispensing mechanism 408 orbits the knocked down container 402 in a direction generally perpendicular to the direction the container 402 moves through the strap applying assembly 400 on the conveyor 404. The speed of the knocked down container 402 on the conveyor 404 relative to the speed of the orbiting tape dispensing mechanism 408 determines the distance between wraps of the reinforcing strap 406. Thus, a small distance between wraps is obtained when the conveyance speed is slow relative to the orbit speed, and a larger distance between wraps is obtained as the conveyance speed is increased relative to the orbit speed. The resulting reinforced container assembly 420 may then be formed into a set-up position and filled with a product.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reinforced container assembly comprising:

a fiberboard container having a lower portion and an upper portion; and a first reinforcement strap wrapped continuously around a periphery of the container a plurality of times in a generally spiraling manner from a starting point of the first reinforcement strap to a terminating point of the first reinforcement strap, the first reinforcement strap being fixedly attached to the container at a first location, and the first reinforcement strap further being fixedly attached to the container at second location, the first reinforcement strap providing structural support to the fiberboard container to increase the strength of the container assembly.

2. The container assembly of claim 1 wherein the fiberboard container is a corrugated fiberboard container.

3. The container assembly of claim 1 wherein the fiberboard container is a non-corrugated fiberboard container.

4. The container assembly of claim 1 wherein the first reinforcement strap is wrapped from about four times to about eight times around the periphery of the container.

5. The container assembly of claim 1 wherein the first reinforcement strap is a fiberglass reinforced adhesive tape.

6. The container assembly of claim 5 wherein the first reinforcement strap is generally continuously fixedly attached to the fiberboard container along the length of the reinforcement strap.

7. The container assembly of claim 1 wherein spacing between each of the wraps of the first reinforcement strap around the periphery of the fiberboard container is generally identical.

8. The container assembly of claim 1 wherein the starting point of the first reinforcement strap is located in a lower portion of the container and the terminating point of the first reinforcement strap is in an upper portion of the container.

9. The container assembly of claim 1 wherein the starting point of the first reinforcement strap is located in an upper portion of the container and the terminating point of the first reinforcement strap is in a lower portion of the container.

10. The container assembly of claim 1 wherein spacing between each of the wraps of the first reinforcement strap around the periphery of the fiberboard container increases from a lower portion of the fiberboard container to an upper portion of the fiberboard container.

11. The container assembly of claim 1 wherein spacing between each of the wraps of the first reinforcement strap around the periphery of the fiberboard container decreases from a lower portion of the fiberboard container to an upper portion of the fiberboard container.

12. The container assembly of claim 1 wherein the first reinforcement strap is wound around at least one location of the periphery of the fiberboard container at least two times.

13. The container assembly of claim 1 wherein spacing between each of the wraps of the first reinforcement strap around the periphery of the fiberboard container varies in a non-uniform manner.

14. The container assembly of claim 1 further comprising a second reinforcement strap wrapped continuously around a periphery of the container a plurality of times in a spiraling manner from a second starting point of the second reinforcement strap to a second terminating point of the second reinforcement strap, the second reinforcement strap being fixedly attached to the container at a third location, and the second reinforcement strap further being fixedly attached to the container at a fourth location, the second reinforcement strap providing structural support to the fiberboard container to increase the strength of the container assembly.

15. The container assembly of claim 1 wherein the first location is generally at the starting point of the first reinforcement strap and the second location is generally at the terminating point of the first reinforcement strap.

16. The container assembly of claim 1 wherein the starting point and the terminating point are both within the lower portion of the container.

17. The container assembly of claim 1 wherein the starting point and the terminating point are both within the upper portion of the container.

18. A reinforced container assembly comprising:

a fiberboard container having a lower portion and an upper portion and a sidewall outer surface area; and a first reinforcement strap wrapped continuously around a periphery of the container a plurality of times, wherein at least a first wrap of the first reinforcement strap occur in a first generally identical vertical location of the container before the wraps form a generally spiraling pattern, the first reinforcement strap being fixedly attached to the container at a first location at a first position of the first reinforcement strap, and the first reinforcement strap further being fixedly attached to the container at a second location at a second position of the first reinforcement strap, the first reinforcement strap providing structural support to the fiberboard container to increase the strength of the container assembly;

wherein, a distance between each of the plurality of wraps in the generally spiraling pattern of the first reinforcement strap around the periphery of the container is greater than a width of the first reinforcement strap.

19. The container assembly of claim 18 wherein the fiberboard container is a corrugated fiberboard container.

20. The container assembly of claim 18 wherein the fiberboard container is a non-corrugated fiberboard container.

21. The container assembly of claim 18 wherein the first reinforcement strap is wrapped from about four times to about eight times around the periphery of the container.

22. The container assembly of claim 18 wherein the first reinforcement strap is a fiberglass reinforced adhesive tape.

23. The container assembly of claim 22 wherein the first reinforcement strap is continuously fixedly attached to the fiberboard container along the total length of the reinforcement strap.

24. The container of claim 23 wherein the first reinforcement strap covers less than about thirty five percent (35%) of the side wall surface area of the container.

25. The container assembly of claim 18 wherein the final wrap of the first reinforcement strap is in a second generally identical vertical location of the container after the wraps form the generally spiraling pattern.

26. The container assembly of claim 18, wherein a first wrap and a second wrap of the reinforcement strap occur in a first generally identical vertical location of the container before the wraps form the generally spiraling pattern.

27. A reinforced container assembly comprising:

a fiberboard container having a lower portion and an upper portion; and a reinforcement strap wrapped continuously around a periphery of the container a plurality of times in a generally spiraling manner from a starting point of the first reinforcement strap to a terminating point of the reinforcement strap, the reinforcement strap being fixedly attached to the container at a first location, and the reinforcement strap further being fixedly attached to the container at second location, the reinforcement strap providing structural support to the fiberboard container to increase the strength of the container assembly, wherein the reinforcement strap is made from a material having an elongation at failure that is less than 5 times the elongation at failure of the material for forming the fiberboard container.

28. The reinforced container assembly of claim 27 wherein the reinforcement strap is made from a material having an elongation at failure that is about 3 times the elongation at failure of the material for forming the fiberboard container.

* * * * *